US007676990B2

(12) United States Patent
Bestler et al.

(10) Patent No.: US 7,676,990 B2
(45) Date of Patent: Mar. 16, 2010

(54) POSITIVE ACTION LOCK FOR SLIDING WINDOWS

(75) Inventors: William Bestler, Owatonna, MN (US); Clark Velzke, Medford, MN (US); Teressa Dickison, Faribault, MN (US)

(73) Assignee: Truth Hardware Corporation, Owatonna, MN (US)

( * ) Notice: Subject to any disclaimer, the term of this patent is extended or adjusted under 35 U.S.C. 154(b) by 328 days.

(21) Appl. No.: 11/712,219

(22) Filed: Feb. 28, 2007

(65) Prior Publication Data

US 2007/0209285 A1 Sep. 13, 2007

Related U.S. Application Data

(60) Provisional application No. 60/777,395, filed on Feb. 28, 2006.

(51) Int. Cl.
*E05B 55/00* (2006.01)

(52) U.S. Cl. ..... 49/449; 292/169; 70/90

(58) Field of Classification Search ..... 49/449; 70/89, 90

See application file for complete search history.

(56) References Cited

U.S. PATENT DOCUMENTS

| | | | | |
|---|---|---|---|---|
| 359,119 | A | 3/1887 | Willcox | |
| 557,134 | A | 3/1896 | Lowe | |
| 739,410 | A | 9/1903 | Goerk et al. | |
| 959,559 | A | 5/1910 | Landis | |
| 1,076,650 | A | 10/1913 | Eddy | |
| 1,439,642 | A * | 12/1922 | Round | 292/58 |
| 1,922,286 | A * | 8/1933 | Gronbech | 160/23.1 |
| 2,061,493 | A | 11/1936 | Tracy | |
| 2,158,260 | A | 5/1939 | Stillman | |
| 2,480,016 | A | 8/1949 | Granberg | |
| 2,776,459 | A * | 1/1957 | Quintanila | 49/162 |
| 2,898,646 | A * | 8/1959 | Gillespie | 49/415 |
| 4,395,847 | A * | 8/1983 | Atchison | 49/406 |
| D308,055 | S | 5/1990 | Tedham et al. | |
| 5,669,639 | A * | 9/1997 | Lawrence | 292/175 |
| 5,901,501 | A | 5/1999 | Fountaine | |
| 6,848,728 | B2 * | 2/2005 | Rotondi et al. | 292/336 |

OTHER PUBLICATIONS

AMSCO *Stylelock*, Mar. 2003, p. 1.
Jeld-Wen/Milgard, New Sash Lock, Mar. 2003, p. 1.
AMSCO Windows, *Components & Equipment, Fenestration*, Sep. 2002, p. 1.
Doug Johnson, Truth Hardware Internal Correspondence, *Positive Action Lock Via Vanguard*, Mar. 4, 2003, p. 2.

* cited by examiner

*Primary Examiner*—Katherine W Mitchell
*Assistant Examiner*—Daniel Cahn
(74) *Attorney, Agent, or Firm*—Patterson, Thuente, Skaar & Christensen, P.A.

(57) ABSTRACT

A sliding window having a pair of sashes with a latch mechanism on the meeting rail of one of the sashes for latching the sashes together. To open the window, the latch mechanism is disengaged by grasping a finger grip on a latch handle to retract a latch bolt. As one or more of the sashes is slid to open the window and the latch mechanism clears the meeting rail of the other sash, a trigger cam rotates so that a portion extends outward from the latch mechanism and another portion releases a spring tab to engage and hold the latch bolt in the retracted position. When the window is closed, the outwardly extending portion of the trigger cam contacts the meeting rail of the other sash, causing the trigger cam to rotate in the opposite direction and releasing the latch bolt.

13 Claims, 3 Drawing Sheets

POSITIVE ACTION LOCK FOR SLIDING WINDOWS

RELATED APPLICATION

The present application claims the benefit of U.S. Provisional Application No. 60/777,395 filed Feb. 28, 2006, which is incorporated herein in its entirety by reference.

FIELD OF THE INVENTION

The present invention relates to windows, and more specifically, to latching mechanisms for sliding windows.

BACKGROUND OF THE INVENTION

Double hung and other sliding sash type windows are very common. Typically, a latch or locking mechanism is used to secure the sashes in place to inhibit unintentional opening of the sashes and unauthorized entry to the structure.

One very common mechanism used to lock sashes together is the so-called check rail lock, which includes a sweep cam attached to a rotatable handle. The check rail lock is mounted on one of the sashes, usually the lower sash of a double-hung window proximate the center of the sash rail. A keeper structure is mounted on the other sash proximate the check rail lock. As the handle is rotated in either direction, the sweep cam is rotated into or out of engagement with the keeper in order to enable locking or opening of the window as desired. These check rail lock devices are simple and relative easy to operate. A drawback of these devices, however, is that the handle can be rotated so that the sweep cam is extended even when the sash is open. When the sash is closed with the sweep cam in such position, the extended position of the sweep cam prevents full closure of the sash. The operator of the window may not notice the window is not fully closed and latched. In addition, the sweep cam may strike and damage the other sash. One example of a check rail lock type mechanism is disclosed in U.S. Pat. No. 6,478,347, hereby fully incorporated herein by reference.

Another prior mechanism includes a sliding latch bolt that may be mounted on one sash and that is selectively engageable with a keeper mounted on the other sash. A drawback with these mechanisms, however, is often that the bolt must either be held in a retracted position as the window is operated. In other case, where a mechanism for holding the bolt in a retracted position is employed, the bolt either releases as soon as the window is raised, or must be manually released with a separate catch or button. In such cases, the window may fail to close fully and may not be noticed by the operator of the window.

What is still needed is a latch mechanism for a sliding window that automatically latches when the window is returned to a closed position.

SUMMARY OF THE INVENTION

The present invention addresses the need of the industry for a sliding window that automatically latches when the window is returned to a closed position. According to an embodiment of the invention, a window is equipped with a sliding latch mechanism having a spring biased rotary trigger cam. The latch mechanism is mounted on a sliding sash of a window assembly opposite a keeper or similar latch bolt receiving structure. With the window in this position, the latch bolt of the mechanism is received in the keeper to latch the sashes together. To open the window, the latch mechanism is disengaged from the keeper by grasping a finger grip on a latch handle and pulling outwardly away from window. The latch handle slides outwardly and pulls the latch bolt out of the keeper. With the latch bolt in this position, the sash may be slid upwardly to open the window. As the latch mechanism clears the lower rail of the upper sash, a torsion spring urges the trigger cam to rotate so that a portion outward toward to lower sash and another portion releases a spring tab to engage and hold the latch bolt in the retracted position. To close the window, the sash is slid downward. The outwardly extending portion of the trigger cam contacts the lower sash, causing the trigger cam to rotate in the opposite direction, releasing the latch bolt. Biasing springs urge the latch bolt forwardly so that it is once again engaged in the keeper and the sashes are latched together as before.

According to an embodiment, a latch mechanism for a sliding window includes a housing defining an opening therein, and a latch bolt slidably disposed in the housing and selectively positionable between an extended position wherein a portion of the latch bolt extends outwardly from the housing through the opening and a retracted position wherein the latch bolt is entirely contained in the housing. A biasing element is operably coupled to the latch bolt and arranged to bias the latch bolt toward the extended position and a resilient latching element is operably coupled with the housing and is arranged to automatically engage and retain the latch bolt in the retracted position as the latch bolt is positioned from the extended to the retracted position. The mechanism further includes a trigger mechanism having a camshaft with a first lobe and a second lobe. The camshaft is disposed in the housing and is rotatable between a first position wherein a portion of the first lobe extends outwardly from the housing and a second position wherein the first lobe is contained in the housing. The second lobe is arranged such that when the camshaft is rotated from the first to the second position, the second lobe contacts and disengages the resilient latching element from the latch bolt.

Embodiments of the invention may include a trigger mechanism wherein a biasing element is operably coupled with the camshaft and is arranged to rotatably bias the camshaft toward the first position. The latch mechanism housing may include a base and a cover, the base including a front wall, a rear wall, a top wall, and an open bottom, and the cover may engage the base to at least partially close the open bottom. The resilient latching element may include a spring tab defined in the cover.

DETAILED DESCRIPTION OF THE INVENTION

Figure 1:
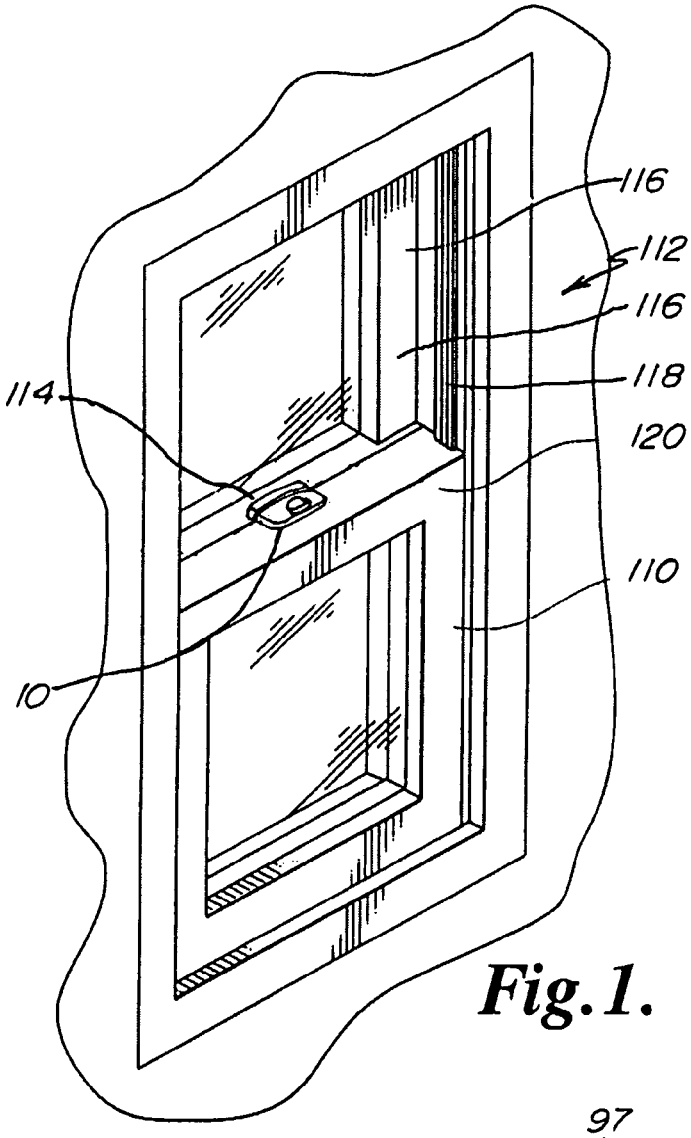
FIG. 1 is a perspective view of a window assembly with a latch mechanism according to an embodiment of the invention mounted thereon.
Figure 2:
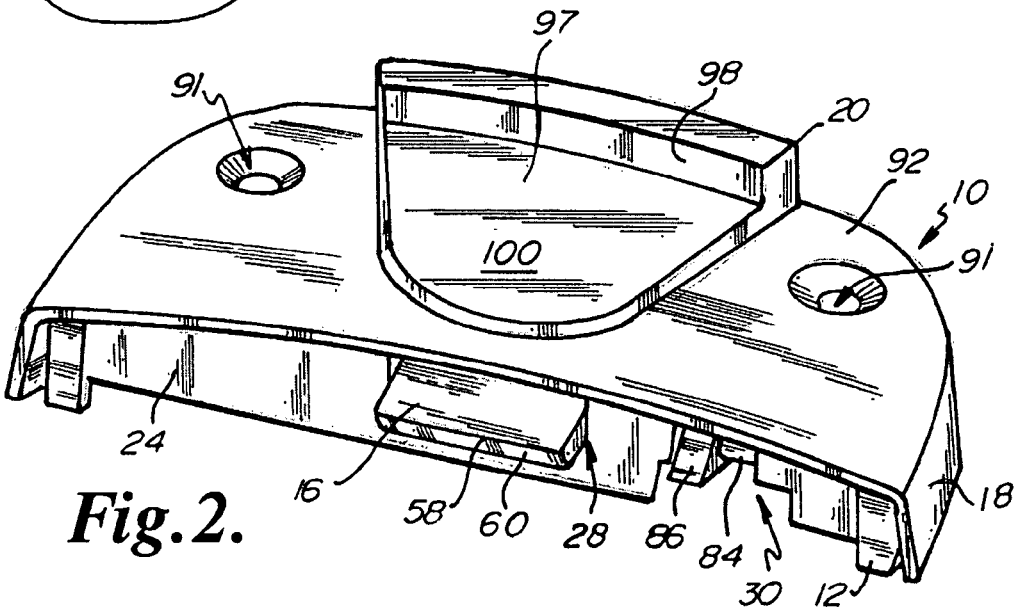
FIG. 2 is a rear perspective view of a fully assembled latch mechanism according to an embodiment of the invention.
Figure 3:
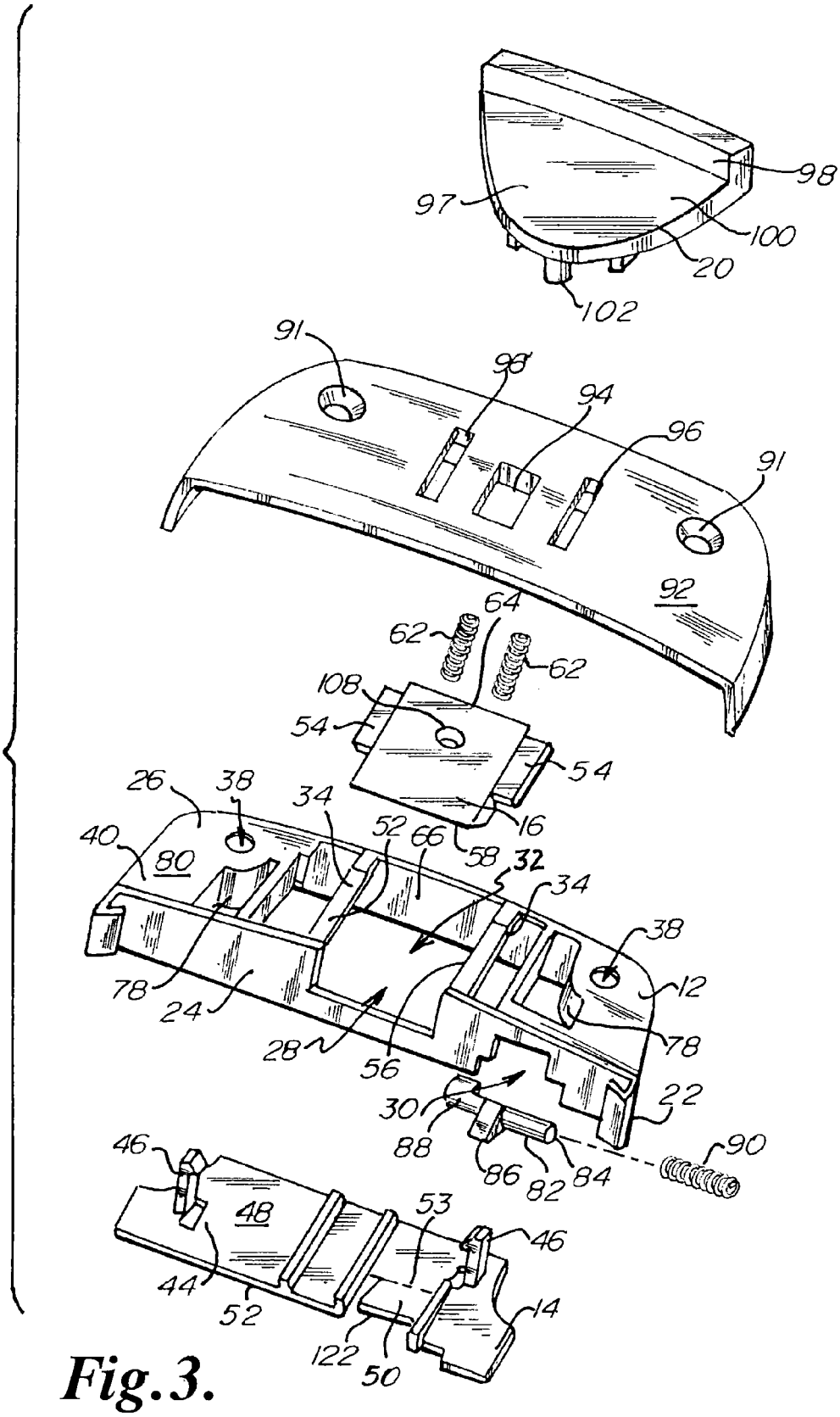
FIG. 3 is a top perspective exploded view of a latch mechanism according to an embodiment of the invention.
Figure 4:
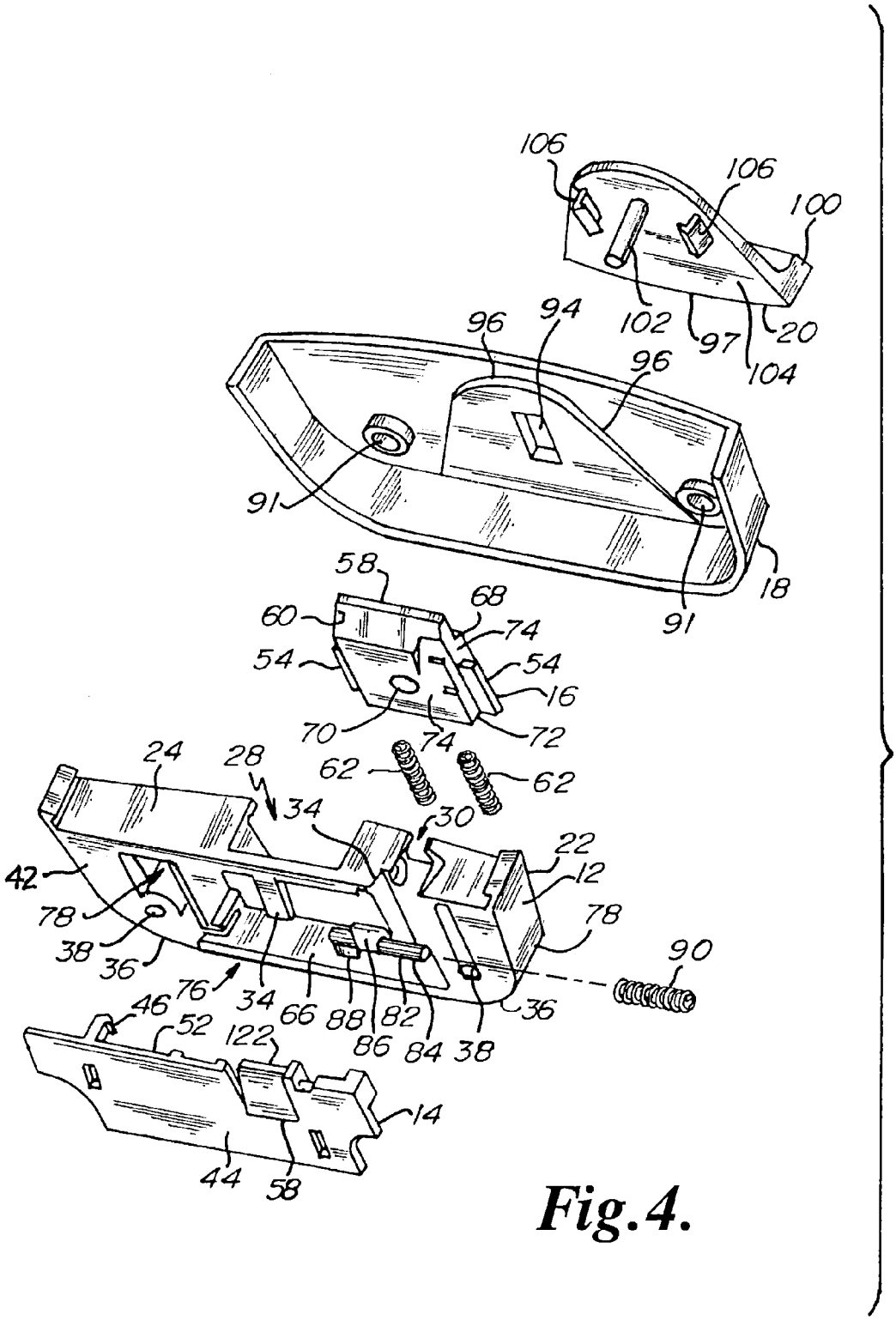
FIG. 4 is a bottom perspective exploded view of a latch mechanism according to an embodiment of the invention.

Latch mechanism 10 generally includes base housing 12, bottom cover 14, latch bolt 16, housing cover 18, and latch handle 20. Base housing 12 generally includes front wall 22, rear wall 24, and top wall 26. Rear wall 24 defines latch aperture 28 and trigger aperture 30. Top wall 26 defines central aperture 32 having latch bolt guides 34 extending from front wall 22 to rear wall 24 on either side of latch aperture 28. Fastener bosses 36 define bores 38 extending from top surface 40 through to bottom surface 42.

Bottom cover 14 has generally planar body portion 44 with hooks 46 projecting upwardly from upper surface 48. Spring tab 50 is defined in body portion 44, extending inwardly from rear edge 52, so as to be resiliently flexible about hinge line 53.

Latch bolt 16 has wings 54 extending laterally from each side, and is slidably disposed in base housing 12, with wings 54 resting on upper surface 56 of latch bolt guides 34. Tapered leading edge 58 extends outward through latch aperture 28, with inclined surface 60 facing downward toward bottom cover 14. Biasing springs 62 are disposed between rear surface 64 of latch bolt 16 and inside surface 66 of front wall 22, so as to bias latch bolt 16 outwardly through latch aperture 28. Recess 68 is formed in bottom surface 70 of latch bolt 16 along lateral edge 72. Downwardly facing ridge structures 74 are provided in recess 68.

Bottom cover 14 is received on bottom side 76 of base housing 12 with hooks 46 extending through apertures 78 in base housing 12 and hooking over upper surface 80 to secure bottom cover 14 on base housing 12. Trigger cam 82 has shaft portion 84 with a pair of lobes 86, 88, extending on opposite sides of shaft portion 84. Trigger cam 82 is rotatably received between base housing 12 and bottom cover 14. Lobe 86 is aligned with trigger aperture 30 so that lobe 86 is extendable therethrough upon rotation of trigger cam 82. Lobe 88 is aligned with spring tab 50, and bears downwardly upon it with rotation of trigger cam 82. Torsion spring 90 fits over shaft portion 84 and is arrange to bias trigger cam 82 against rotation.

Housing cover 18 fits over upper surface 80 with fastener holes 91 aligned with bores 38. Upper wall 92 defines central slot 94 and guide slots 96. Latch handle 20 generally includes planar body portion 97 with finger grip 98 extending upwardly from upper surface 100. Post 102 extends downwardly proximate the center of lower surface 104, flanked by a pair of guides 106. Latch handle 20 is slidably disposed on upper wall 92 of housing cover 18 with post 102 extending through slot 102 and each of guides 106 through a separate one of guide slots 96. Post 102 engages in aperture 108 in latch bolt 16, so that latch bolt 16 slides with movement of latch handle 20.

In use, latch mechanism 10 is mounted on a sliding sash 110 of a window assembly 112 opposite a keeper 114 or similar latch bolt receiving structure. With the window in this position, tapered leading edge 58 is received in keeper 114 to latch the sashes 110, 116, together. To open window 112, latch mechanism 10 is disengaged from keeper 114 by grasping finger grip 98 with the fingers and pulling outwardly away from window 112. Latch handle 20 slides outwardly, pulling latch bolt 16, against the bias of springs 62, out of keeper 114 until latch bolt 16 is substantially within base housing 12. With latch bolt 16 in this position, sash 110 may be slid upwardly along track 118 to open the window 112. As latch mechanism 10 clears lower rail 120 of sash 116, torsion spring 90 urges rotation of trigger cam 82 so that lobe 86 extends outward through trigger aperture 30 and lobe 88 is rotated off spring tab 50. The resilience of spring tab 50 causes end 122 to move upwardly, engaging one of ridge structures 74 on latch bolt 16, thereby holding latch bolt 16 in the retracted position.

To close window 112, sash 110 is slid downward along track 118. Lobe 86 of trigger cam 82 contacts sash 116, causing trigger cam 82 to rotate against the bias of torsion spring 90. As trigger cam 82 rotates, lobe 88 rotates into contact with spring tab 50 and presses it downward, disengaging end 122 from ridge structures 74. Biasing springs 62 urge latch bolt 16 forwardly so that leading edge 58 is once again engaged in keeper 114 and sashes 110, 116 are latched together as before.

It will be appreciated that the various components of latch mechanism 10 may be made from any materials suitable in strength and durability. It is currently preferred that base housing 12 is made from die-cast metal, while bottom cover 14, latch bolt 16, housing cover 18 and latch handle 20 are made from polymer blends. Moreover, it will be appreciated that latch mechanism 10 may be used with any sliding window or opening, including without limitation, double hung windows and laterally sliding windows having one, two, or any other number of sliding sash assemblies.

The present invention may be embodied in other specific forms without departing from the spirit of the essential attributes thereof. Therefore, the described embodiments should be considered in all respects as illustrative and not restrictive with the appended claims defining the scope of the invention.

What is claimed is:

1. A latch mechanism for a sliding window comprising:

a housing including a base having a front wall, a rear wall, a top wall, and an open bottom, the rear wall defining an opening therein;

a latch bolt slidably disposed in the housing and selectively positionable between an extended position wherein a portion of the latch bolt extends outwardly from the housing through the opening and a retracted position wherein the latch bolt is entirely contained in the housing;

a biasing element operably coupled to the latch bolt and arranged to bias the latch bolt toward the extended position;

a bottom housing cover closing the open bottom of the housing, the bottom housing cover having a resilient latching element the resilient latching element arranged to automatically engage and retain the latch bolt in the retracted position as the latch bolt is positioned from the extended to the retracted position; and a trigger mechanism comprising:

a camshaft having a first lobe and a second lobe, the camshaft disposed in the housing and being rotatable between a first position wherein a portion of the first lobe extends outwardly from the housing and a second position wherein the first lobe is contained in the housing, the second lobe arranged such that when the camshaft is rotated from the first to the second position, the second lobe contacts and disengages the resilient latching element from the latch bolt.

2. The latch mechanism of claim 1, wherein the trigger mechanism further comprises a biasing element operably coupled with the camshaft and arranged to rotatably bias the camshaft toward the first position.

3. The latch mechanism of claim 1, wherein the resilient latching element comprises a spring tab defined in the cover.

4. The latch mechanism of claim 1, wherein the first lobe extends through a second opening defined in the rear wall when the camshaft is in the first position.

5. The latch mechanism of claim 1, further comprising a housing cover disposed over the housing and a latch handle operably coupled with the latch bolt and slidable on the housing cover.

6. A sliding window comprising:

a frame with a first and a second sash assembly in the frame, each of the first and second sash assemblies having a meeting rail, wherein at least the first sash assembly is selectively slidable in the frame between a window closed position wherein the meeting rails of the first and second sashes are confronting each other and a window open position wherein the meeting rails of the first and second sashes are clear of each other; and a latching mechanism disposed on the meeting rail of either the first or second sash for selectively latching the first and second sashes together, the latching mechanism comprising:

a housing defining an opening therein;

a latch bolt slidably disposed in the housing and selectively positionable between an extended position wherein a portion of the latch bolt extends outwardly from the housing through the opening to latch the first and second sashes together and a retracted position wherein the latch bolt is entirely contained in the housing;

means for biasing the latch bolt toward the extended position;

means for automatically engaging and retaining the latch bolt in the retracted position as the latch bolt is positioned from the extended to the retracted position, the means for automatically engaging and retaining the latch bolt in the retracted position including a spring tab defined in the housing, wherein the spring tab is engaged with the latch bolt when the latch bolt is in the retracted position; and trigger means for releasing the latch bolt from the retracted position when the meeting rails of the first and second sashes meet as the first sash is positioned from the window open to the window closed position.

7. The sliding window of claim 6, wherein the first sash slides vertically in the frame.

8. The sliding window of claim 6, wherein the trigger means includes a camshaft having at least a first lobe, the camshaft disposed in the housing and being rotatable between a first position wherein a portion of the first lobe extends outwardly from the housing and a second position wherein the first lobe is contained in the housing.

9. The sliding window of claim 6, wherein the camshaft includes a second lobe, the second lobe arranged such that when the camshaft is rotated from the first to the second position, the second lobe contacts and disengages the spring tab from the latch bolt.

10. A sliding window comprising:

a frame with a first and a second sash assembly in the frame, each of the first and second sash assemblies having a meeting rail, wherein at least the first sash assembly is selectively slidable in the frame between a window closed position wherein the meeting rails of the first and second sashes are confronting each other and a window open position wherein the meeting rails of the first and second sashes are clear of each other; and a latching mechanism disposed on the meeting rail of either the first or second sash for selectively latching the first and second sashes together, the latching mechanism comprising:

a housing including a base with a front wall, a rear wall, a top wall, and an open bottom, the rear wall defining an opening therein;

a biasing element operably coupled to the latch bolt and arranged to bias the latch bolt toward the extended position;

a bottom housing cover closing the open bottom of the housing and having a resilient latching element, the resilient latching element arranged to automatically engage and retain the latch bolt in the retracted position as the latch bolt is positioned from the extended to the retracted position; and a trigger mechanism comprising a camshaft having a first lobe and a second lobe, the camshaft disposed in the housing and being rotatable between a first position wherein a portion of the first lobe extends outwardly from the housing and a second position wherein the first lobe is contained in the housing, the second lobe arranged such that when the meeting rails of the first and second sashes meet as the first sash is positioned from the window open to the window closed position, the camshaft is rotated from the first to the second position and the second lobe contacts and disengages the resilient latching element from the latch bolt.

11. The sliding window of claim 10, wherein the first sash slides vertically in the frame.

12. The sliding window of claim 10, wherein the first lobe extends through a second opening defined in the rear wall when the camshaft is in the first position.

13. The sliding window of claim 10, further comprising a housing cover disposed over the housing and a latch handle operably coupled with the latch bolt and slidable on the housing cover.

* * * * *